US006957865B1

(12) United States Patent
Adams et al.

(10) Patent No.: US 6,957,865 B1
(45) Date of Patent: Oct. 25, 2005

(54) ADJUSTABLE CHAIR

(75) Inventors: Joseph W. Adams, Strongsville, OH (US); Christopher H. Delgado, Stow, OH (US)

(73) Assignee: Invacare Corporation, Elyria, OH (US)

( * ) Notice: Subject to any disclaimer, the term of this patent is extended or adjusted under 35 U.S.C. 154(b) by 0 days.

(21) Appl. No.: 10/709,123

(22) Filed: Apr. 14, 2004

(51) Int. Cl.[7] ..... A47C 1/02
(52) U.S. Cl. ..... 297/344.12
(58) Field of Search ..... 297/463.1, 463.2, 297/344.18, 344.12, 338; 248/188.4; 403/296, 403/351, DIG. 7

(56) References Cited

U.S. PATENT DOCUMENTS

| | | | | |
|---|---|---|---|---|
| 1,922,418 | A * | 8/1933 | Conant | 297/357 |
| 2,389,610 | A | 11/1945 | Christenson, Jr. | |
| 3,150,853 | A * | 9/1964 | Lisbin | 248/188.4 |
| 4,313,586 | A | 2/1982 | Grzesnikowski | |
| 4,653,968 | A | 3/1987 | Rapata et al. | |
| 4,728,150 | A * | 3/1988 | Gaudreau, Jr. | 297/383 |
| 5,335,377 | A | 8/1994 | Masyada et al. | |
| 5,536,068 | A | 7/1996 | Valentor et al. | |
| 5,678,892 | A * | 10/1997 | Heitlinger | 297/344.18 |
| 5,722,627 | A | 3/1998 | Hoshino | |
| 5,749,557 | A | 5/1998 | Chang | |
| 6,015,190 | A | 1/2000 | Wend | |
| 6,056,353 | A * | 5/2000 | Meara | 297/41 |
| 6,196,505 | B1 | 3/2001 | Wainwright | |
| 6,354,231 | B1 * | 3/2002 | Morris | 108/144.11 |
| D479,051 | S | 9/2003 | Darst et al. | |
| 2003/0102700 | A1 * | 6/2003 | Lin | 297/183.9 |

* cited by examiner

*Primary Examiner*—Milton Nelson, Jr.
(74) *Attorney, Agent, or Firm*—Calfee, Halter & Griswold LLP

(57) ABSTRACT

An adjustable leg for a chair includes a leg housing, secured to a seat, that includes a threaded inner wall. A leg extension is received into the leg housing and includes external threaded portions that mate with the threaded inner wall. A tab in the leg housing cooperates with the external threaded portions and secures the leg extension at a predefined position in the leg housing.

26 Claims, 7 Drawing Sheets

ADJUSTABLE CHAIR

BACKGROUND OF INVENTION

The present invention relates to chairs having a height adjustment. It finds particular application in conjunction with bathing chairs and will be described with particular reference thereto. It will be appreciated, however, that the invention is also amenable to other applications.

Adjustable chairs are useful for assisting disabled persons while bathing. Depending on the type and/or severity of the disability, a person may prefer or have no choice but to sit while bathing. In this case, it is desirable to use a chair having a seat easily adjustable to various heights. Furthermore, because the terrain of the bathing area (e.g., a tub or shower) may be uneven, it is also desirable that the legs be independently adjustable to accommodate even slight irregularities in the surface of the bathing area while ensuring that the seat is level (e.g., parallel to the ground).

One conventional chair used for assisting disabled persons while bathing includes a leg having an upper portion secured to an underside of a seat. A continuously threaded section extends from the upper portion of the leg. A lower portion of the leg includes a hollow cavity with continuous threads that mate with the threaded section of the upper portion. The threaded section of the upper portion is screwed into the cavity of the lower portion until a desired height of the seat is attained. Furthermore, the height of the seat is adjusted by turning (e.g., screwing and/or unscrewing) the threaded section of the upper portion to a new position within the cavity.

Although the mating threads on the respective portions of the legs provide a means for adjusting a height of the seat, no means for indexing the height of the legs and/or comparing the height of one leg of the chair with respect to any of the other legs is provided. Therefore, assembling the chair to sit on a relatively flat surface requires a trial-by-error approach whereby a user makes a first attempt at adjusting the legs to achieve a level seat. Then, the user places the chair on the ground and makes the necessary adjustments to the heights of the respective legs until the seat is level and, furthermore, the desired height of the seat is achieved. Obviously, this multi-step process of leveling the seat at a desired height is cumbersome.

Furthermore, conventional bathing chairs having independently attachable legs do not offer desired levels of stability.

Also, the seat portions of conventional bathing seats are not curved in a way that creates a perception of a more accommodating seat.

The present invention provides a new and improved apparatus and method which addresses the above-referenced problems.

SUMMARY OF INVENTION

In one embodiment, an adjustable leg for a chair includes a leg housing, secured to a seat, that includes a threaded inner wall. A leg extension is received into the leg housing and includes external threaded portions that mate with the threaded inner wall. A tab in the leg housing cooperates with the external threaded portions and secures the leg extension at a predefined position in the leg housing.

In another embodiment, an adjustable leg for a chair includes a leg housing secured to a seat. An insert is secured in the leg housing and includes a threaded inner wall. A leg extension is received into the insert and includes external threaded portions that mate with the threaded inner wall. A depression is defined between the threaded portions. A tab on the insert cooperates with the threaded portions and the depression. The leg extension is secured at a predefined position in the insert when the tab is in the depression.

In another embodiment, a chair has an adjustable leg. The leg includes an upper leg portion secured to a seat. An insert is secured in the upper leg portion and includes a threaded inner wall. A lower leg portion is received in the insert and includes a partial external threaded portion, which mates with the threaded inner wall, and a valley. A means provides visual and tactile feedback to a user when the lower leg portion is at a predetermined position in the upper leg portion.

In another embodiment, an adjustable leg for a chair includes a leg housing secured to a seat. A leg extension is received into the housing and includes external threaded portions that mate with a threaded inner wall of the leg housing. A plurality of indices are between the threaded portions on the leg extension. A locking mechanism is associated with the leg housing. Preset positions of the leg extension within the housing are determined as a function of respective ones of the indices being engaged with the locking mechanism.

In another embodiment, a method for adjusting a leg of a chair includes rotating a leg extension within an insert that is secured within a leg housing. External threaded portions of the leg extension mate with a threaded inner wall of the insert as the leg extension is rotated. When the leg extension is at a predefined position in the insert, a tab on an inner surface of the insert engages in a valley between the threaded portions.

BRIEF DESCRIPTION OF DRAWINGS

In the accompanying drawings which are incorporated in and constitute a part of the specification, embodiments of the invention are illustrated, which, together with a general description of the invention given above, and the detailed description given below, serve to exemplify the embodiments of this invention.

DETAILED DESCRIPTION

Figure 1:
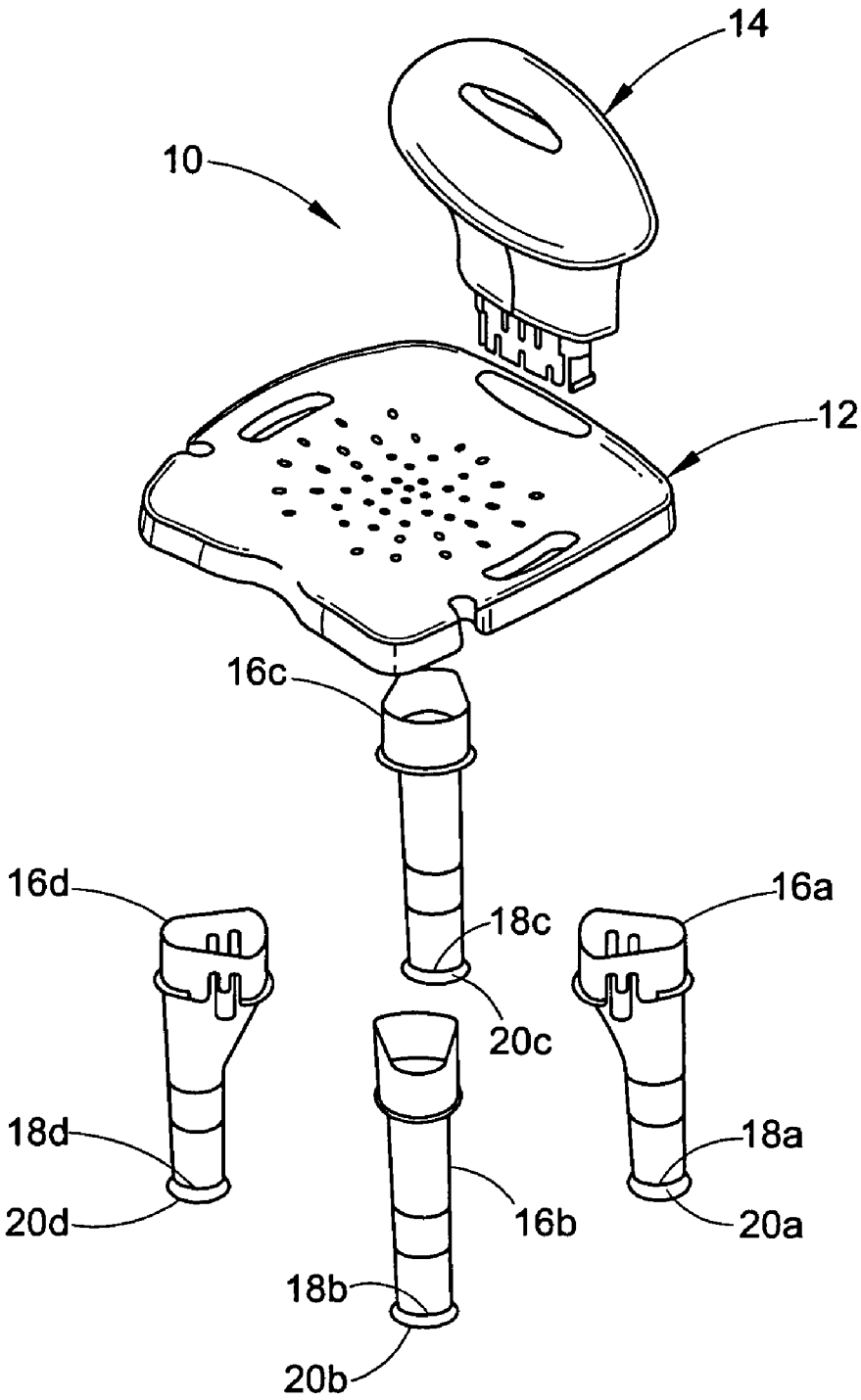
FIG. 1 illustrates an exploded view of a chair in accordance with one embodiment of the present invention.

With reference to FIG. 1, a chair 10 according to the present invention includes a seat portion 12, a back portion 14, and a plurality of leg housings 16*a*, 16*b*, 16*c*, 16*d* secured to the seat portion 12. Although four (4) leg housings 16*a*, 16*b*, 16*c*, 16*d* are shown in the illustrated embodiment, it is to be understood that other numbers of leg housings are also contemplated. A plurality of leg extensions 20*a*, 20*b*, 20*c*, 20*d* are received in respective inserts 18*a*, 18*b*, 18*c*, 18*d*, which are secured in the leg housings 16*a*, 16*b*, 16*c*, 16*d*.

Figure 2:
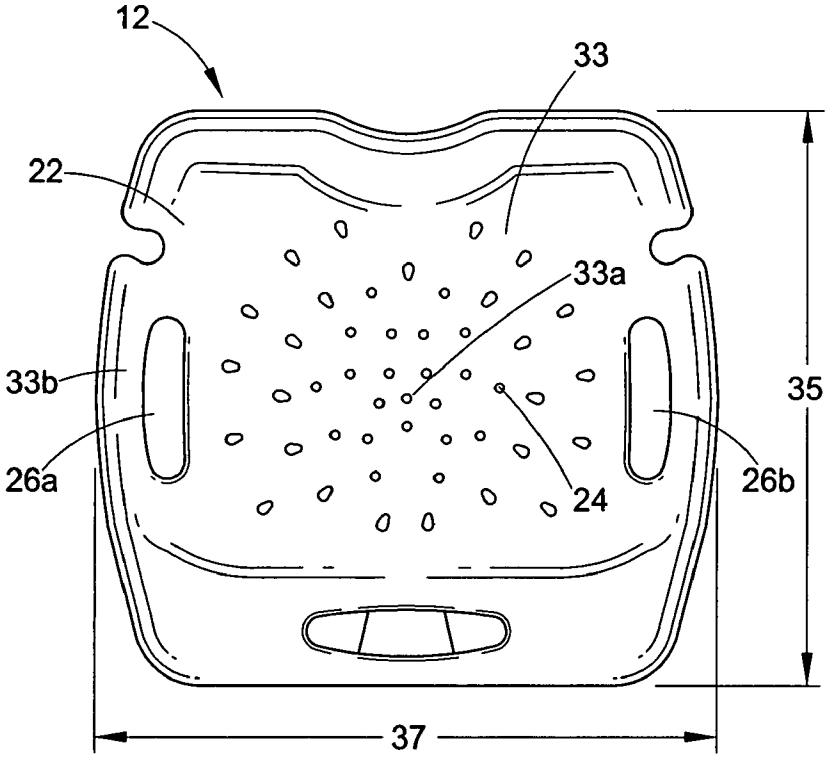
FIG. 2 illustrates a top of the seat portion in accordance with one embodiment of the present invention.
Figure 4:
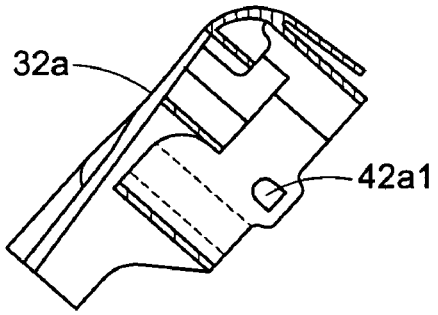
FIGS. 4–17 illustrate various cross-sectional views through the bottom of the seat portion in FIG. 3.
Figure 5:
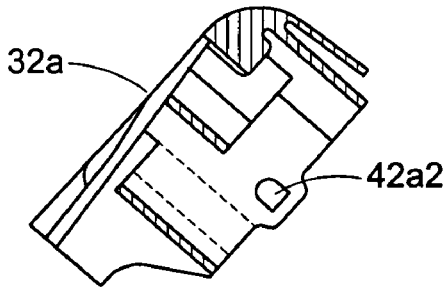
Figure 6:
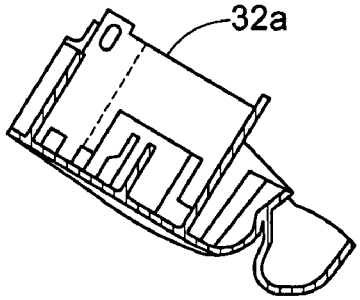
Figure 7:
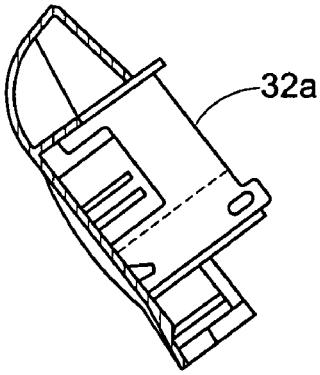
Figure 8:
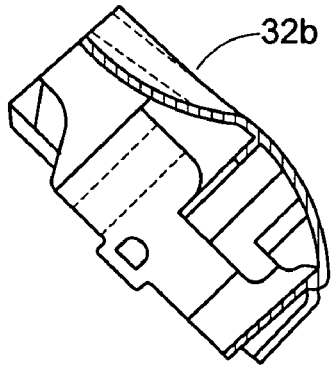
Figure 9:
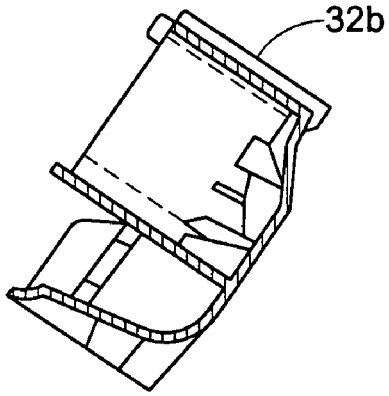
Figure 10:
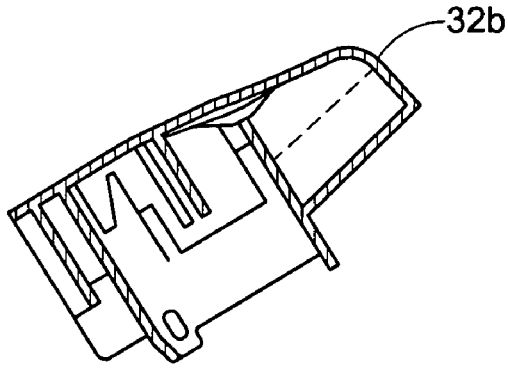
Figure 11:
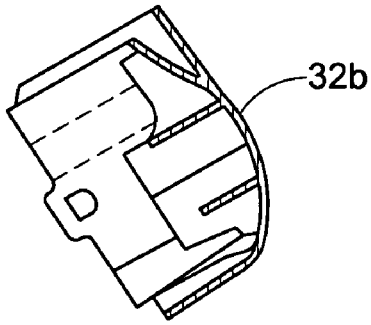

With reference to FIG. 2, a top portion 22 of the seat portion 12 includes a plurality of holes 24 for providing drainage. A plurality (e.g., two (2)) of hand grips 26*a*, 26*b* are also provided.

Figure 3:
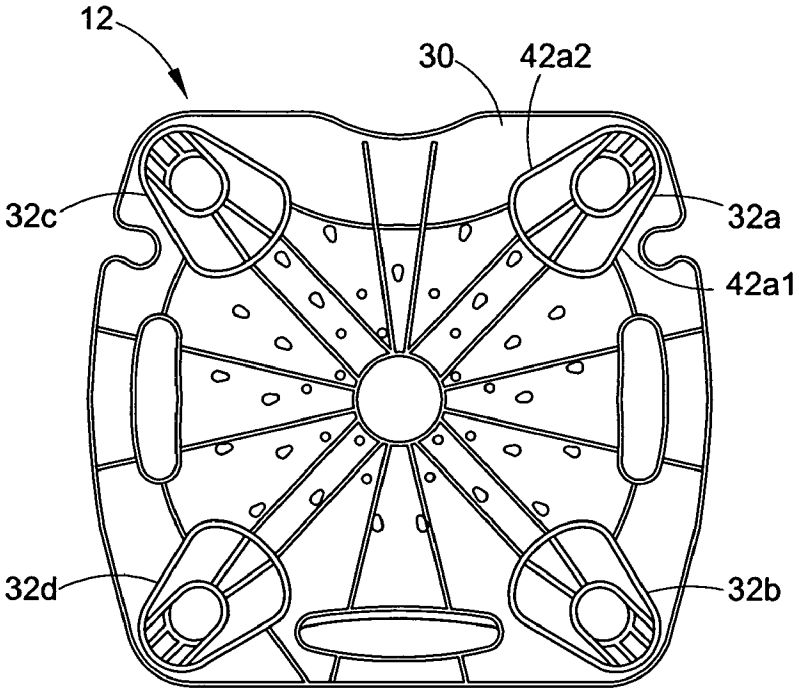
FIG. 3 illustrates a bottom of the seat portion in accordance with one embodiment of the present invention.
Figure 12:
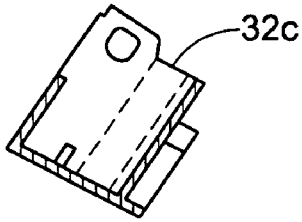
Figure 13:
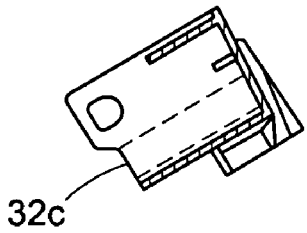
Figure 14:
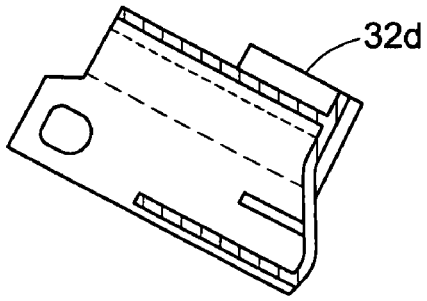
Figure 15:
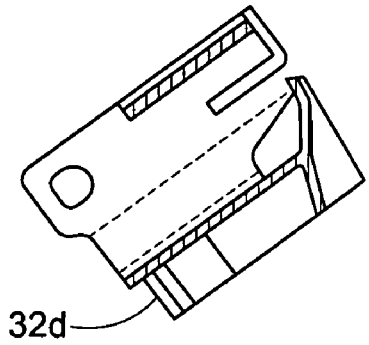
Figure 18:
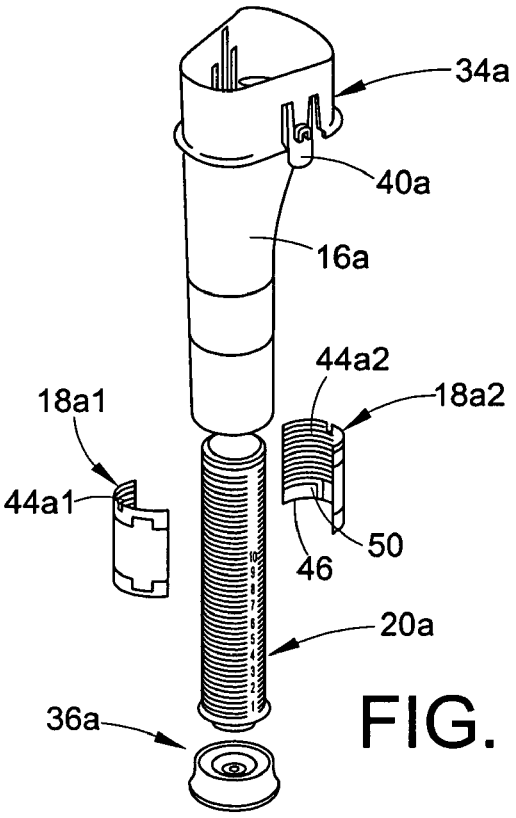
FIG. 18 illustrates an exploded view of a leg housing, an insert, and a leg extension in accordance with one embodiment of the present invention.

With reference to FIG. 3, a bottom portion 30 of the seat portion 12 includes a plurality of housing receiving portions 32*a*, 32*b*, 32*c*, 32*d*, which are designed to mate with an upper portion 34*a* (see FIG. 16) of the leg housing 16*a* (see FIG. 18). FIGS. 4–7 illustrate cross-sectional views of the housing receiving portion 32*a*. FIGS. 8–11 illustrate cross-sectional views of the housing receiving portion 32*b*. FIGS. 12 and 13 illustrate cross-sectional views of the housing receiving portion 32*c*. FIGS. 14 and 15 illustrate cross-sectional views of the housing receiving portion 32*d*.

With reference again to FIG. 3, each of the housing receiving portions 32*a*, 32*b*, 32*c*, 32*d* is a pocket having a triangular lobe geometry. Each of the pockets is deep enough (e.g., at least about 2.0 inches deep) for providing adequate contact area between the housing receiving portions 32*a*, 32*b*, 32*c*, 32*d* and the respective leg housings 16*a*, 16*b*, 16*c*, 16*d* to increase lateral stability. Furthermore, the pocket design of the housing receiving portions 32*a*, 32*b*, 32*c*, 32*d* provides for easy interchangeability between various leg extensions 20*a*, 20*b*, 20*c*, 20*d* (see FIG. 1) (e.g., leg extensions made from different materials such as composite materials and/or metals including aluminum).

Figure 16:
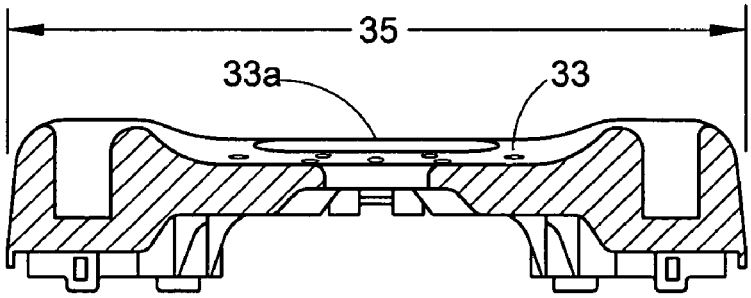
Figure 17:
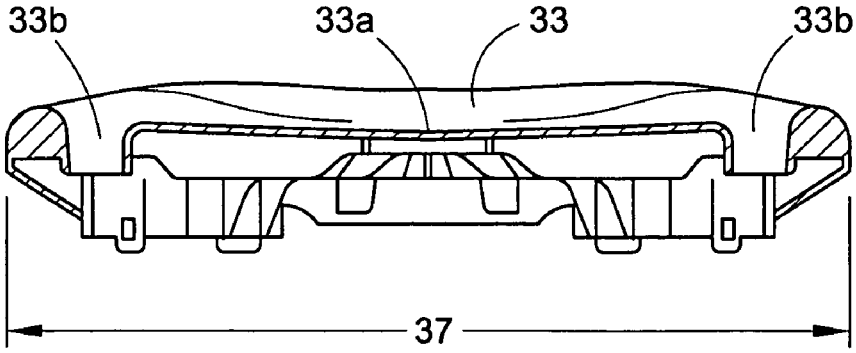

FIGS. 16 and 17 illustrate cross-sectional views through the seat portion 12. A seating surface 33 of the seat portion 12 is dished in such a fashion that a center 33*a* of the seating surface 33 is lower than an outer edge 33*b* of the seating surface 33. Also, a depth 35 (front to back) of the seating surface 33 area is less than a width 37 (side to side) of the seating surface 33 area. The gradual radius and seating surface proportions provides a smooth and comfortable surface that cradles the user. In one embodiment, the center 33*a* of the seating surface 33 is lower than the outer edge 33*b* by about 0.875 inches, the depth 35 is about 75% of the width 37, and the dished surface is radius at about 60 inches; however, other embodiments, which include other dimensions, are also contemplated.

FIG. 18 illustrates a perspective view of the leg housing 16*a*, the insert 18*a*, the leg extension 20*a*, and a tip portion 36*a*, which is secured to a bottom of the insert 18*a*. The top portion 34*a* includes locking tabs (one of which is illustrated as 40*a* and one of which is not shown). The locking tabs 40*a* cooperate with openings 42*a*1, 42*a*2 (see FIGS. 3–5) in the respective housing receiving portion 32*a* (without the use of tools) to secure the leg housing 16*a* to the housing receiving portion 32*a*. The locking tabs 40*a* are biased in an outward direction from the housing receiving portion 32*a* to facilitate engagement in the openings 42*a*1, 42*a*2. In the illustrated embodiment, the locking tabs 40*a* are of a sufficient length and positioned on substantially opposite sides of the top portion 34*a* for facilitating disengagement of the top portion 34*a* from the housing receiving portion 32*a* when a user merely uses a single hand for performing the disengagement. In one embodiment, the tip portion 36*a* is a non-skid material (e.g., a material that may be injection molded as a soft substance such as rubber or Sarlink from DSM, Inc.) that improves traction with a ground surface.

Figure 19:
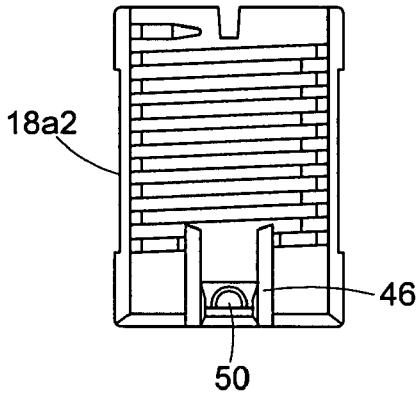
FIG. 19 illustrates a sectional view of the insert in accordance with one embodiment of the present invention.

In the illustrated embodiment, the insert 18*a* includes a plurality (e.g., two (2)) portions 18*a*1, 18*a*2. Each of the portions 18*a*1, 18*a*2 includes an internally threaded wall portion 44*a*1, 44*a*2. Furthermore, one of the portions 44*a*2 includes a flexing portion 46 (see FIG. 19) and a tab 50 (see FIG. 19) (locking device or mechanism) on the inner wall. In one embodiment, the tab 50 includes a well (recessed portion), which is defined by walls of the flexing portion 46. The portions 18*a*1, 18*a*2 are assembled together to form the insert 18. When the portions 18*a*1, 18*a*2 are secured together, the internally threaded wall portions cooperate to form a continuous internally threaded wall on the insert 18. Also, the tab 50 is biased toward a center of the insert 18 by the flexing portion 46. The insert 18*a* is frictionally secured in a cavity at the bottom end of the leg housing 16*a*.

Figure 20:
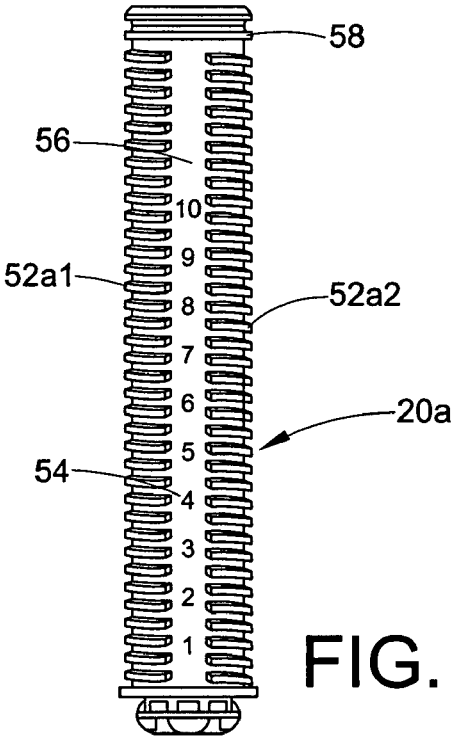
FIG. 20 illustrates the leg insert in accordance with one embodiment of the present invention.

With reference to FIG. 20, the leg extension 20*a* includes a plurality (e.g., two (2)) of external threaded portions 52*a*1, 52*a*2 and a plurality of indicators 54 (indices), which are positioned along a longitudinal axis of the leg extension 20*a* and between the threaded portions 52*a*1, 52*a*2. The threaded portions 52*a*1, 52*a*2 are raised with respect to a remainder of the portion 56 (e.g., valley or depression) between the threaded portions 52*a*1, 52*a*2. In one embodiment, the indicators 54 are also raised with respect to the portion 56. The threaded portions 52*a*1, 52*a*2 of the leg extension 20*a* are sized for mating with the internally threaded wall of the insert 18*a* (see FIG. 18). Therefore, the leg extension 20*a* is drawn into (or extended from) the insert 18*a* (see FIG. 18) and the leg housing 16*a* (see FIG. 18) as the leg extension 20*a* is rotated. The leg extension 20*a* also includes a collar 58, which abuts the insert 18 (see FIG. 18) when the leg extension 20*a* is fully extended from the housing 16*a* (see FIG. 18). In this manner, the collar 58 prevents the leg extension 20*a* from being completely unscrewed from the housing (see FIG. 18).

With reference again to FIG. 18, as the leg extension 20*a* is drawn into the leg housing 16*a*, the tab 50 rides on (over) the threaded portions 52*a*1, 52*a*2 and also rides in the portion 56 between the threaded portions 52*a*1, 52*a*2. The edges of the threaded portions 52*a*1, 52*a*2 are sloped to cooperate with the oncoming edge of the tab 50 as the leg extension 20*a* is rotated into the insert 18*a*. More specifically, as the leg extension 20*a* is rotated into the insert 18*a* and the leg housing 16*a*, the tab 50 rides over one of the threaded portions 52*a*1, into the space 56 between the threaded portions 52*a*1, 52*a*2, and then over the other of the threaded portions 52*a*2. The sloped edges of the threaded portions 52*a*1, 52*a*2 ease the transition of the tab 50 from the space 56 between the threaded portions to the next threaded portion 52*a*1, 52*a*2. Consequently, a user screwing the leg extension 20*a* into the insert 18*a* feels resistance as the tab 50 transitions from one of the threaded portions 52*a*1, 52*a*2, to the space 56 between the threaded portions, and then to the other of the threaded portions 52*a*1, 52*a*2.

The leg extension 20*a* is secured in the insert 18*a* when the tab 50 is in the space 56 between the threaded portions 52*a*1, 52*a*2. The number of the indicators 54 exposed from the insert 18*a* represent a length of the leg extension 20*a* extending from the insert 18*a*.

In another embodiment, the well defined by the tab 50 is sized to be seated over and surround the indicators 54 included on the leg extension 20*a*. More specifically, as the tab 50 encounters the first one of the indicators 54, the flexing portion 46 causes the first wall of the tab 50 to move over the indicator 54 (index). Then, as the user continues to turn the leg extension 20*a*, the indicator 54 becomes removably secured in the well between the two walls of the tab 50.

The respective indicators 54 become secured in the tab 50 at predetermined (preset) positions in the insert 18*a* (and the leg housing 16*a*). Therefore, a length of the leg extension 20*a* extending from the leg housing 16*a* is related to the indicator 54 secured by the tab 50. In other words, the user may determine the length of the leg extension 20*a* extending from the leg housing 16*a* by observing which one of the indicators 54 is secured by the tab 50. Then, the user may determine the length of the leg extension 20*a* extending from the leg housing 16*a* as a function of the indicator 54 secured by the tab 50.

When the indicator 54 is secured in the well defined by the tab 50, the user feels resistance when turning the leg extension 20*a*. By exerting enough force, the user can turn through the resistance so that the indicator 54 is disengaged from the tab 50 and the tab 50 begins riding over the next one of the threaded portions 52*a*1, 52*a*2. The increased resistance the user feels as the tab 50 encounters the indicators 54 provide a means of tactile feedback to the user regarding the amount of the leg extension 20*a* extending from the leg housing 16*a*. Furthermore, in one embodiment, the indicators 54 are numbers in numerical order that provide a means of visual feedback to the user regarding the amount of the leg extension 20*a* extending from the leg housing 16*a*.

It is expected that the respective indicators 54 on the various leg extensions 20*a*, 20*b*, 20*c*, 20*d* (see FIG. 1) will be utilized by the user to adjust all of the legs to a common height. For example, if the tabs 50 on the respective leg housings 16*a*, 16*b*, 16*c*, 16*d* are secured over a corresponding one of the indicators 54 on each of the leg extensions 20, the seat portion 12 will be substantially level if the chair 10 is placed on a level surface.

Although only one of the leg housings 16*a*, inserts 18*a*, and extensions 20*a* have been illustrated, it is to be understood the other leg housings, inserts, and extensions are assembled in a similar manner.

Each of the top portions 34*a*, 34*b*, 34*c*, 34*d* is shaped to fit within the respective housing receiving portions 32*a*, 32*b*, 32*c*, 32*d* (see FIG. 3) in a single orientation, thereby helping to assure correct assembly. Furthermore the top portions 34*a*, 34*b*, 34*c*, 34*d* are shaped as triangular lobes including straight, flat surfaces for distributing forces in the leg housings 16*a*, 16*b*, 16*c*, 16*d* and the leg extensions 20*a*, 20*b*, 20*c*, 20*d*, which are generated by a user moving on the seat portion 12 (see FIG. 1). Because such forces are distributed over a relatively large area, internal stresses acting on the top portions 34*a*, 34*b*, 34*c*, 34*d* are reduced. The flat surfaces also reduce rocking when the user moves on the seat portion, thereby reinforcing the user's perception regarding the stability of the chair.

Figure 21:
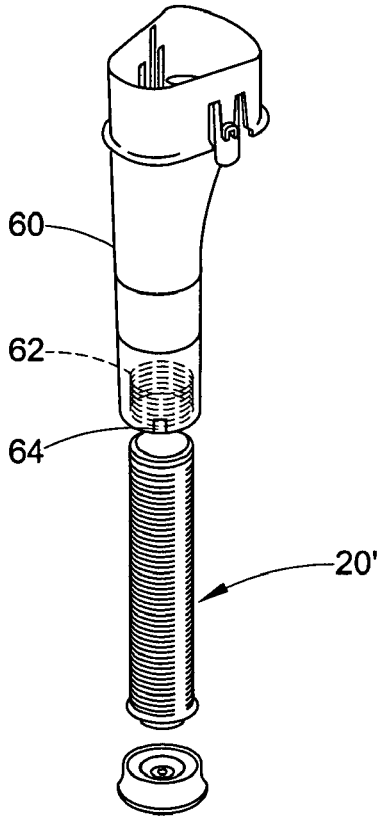
FIG. 21 illustrates another embodiment of the present invention.

FIG. 21 illustrates another embodiment of the present invention. For ease of understanding this embodiment, like components are designated by like numerals with a primed (') suffix and new components are designated by new numerals. In this embodiment, a leg housing 60 includes an internally threaded wall 62. Therefore, the leg extension 20' screws directly into the leg housing 60. A locking mechanism 64 (tab) on the leg housing 60 interacts with the depression between threaded portions on the leg extension 20' as described above.

Figure 22:
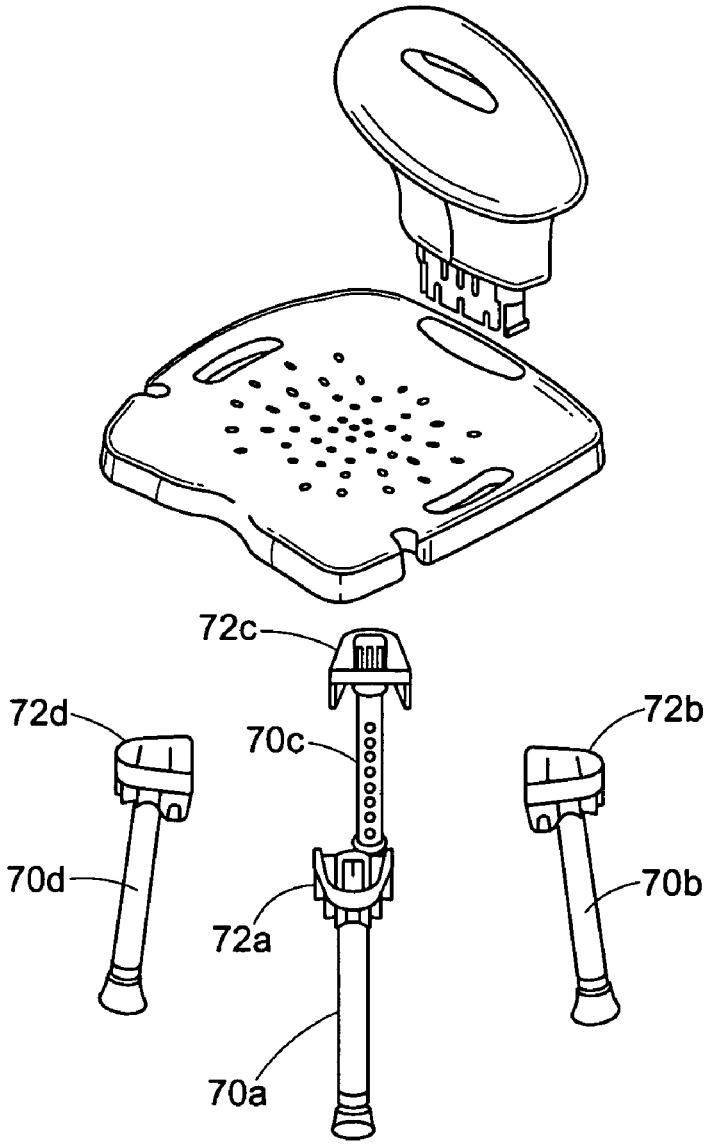
FIG. 22 illustrates another embodiment of the present invention.

FIG. 22 illustrates another embodiment of the present invention. In this embodiment, telescoping legs 70*a*, 70*b*, 70*c*, 70*d* made from a non-composite material (e.g., metal such as aluminum) include respective upper portions 72*a*, 72*b*, 72*c*, 72*d* having the triangular lobe shape for mating with the housing receiving portions 32*a*, 32*b*, 32*c*, 32*d* (see FIG. 3).

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the invention, in its broader aspects, is not limited to the specific details, the representative apparatus, and illustrative examples shown and described. Accordingly, departures may be made from such details without departing from the spirit or scope of the applicant's general inventive concept.

What is claimed is:

1. An adjustable leg for a chair, comprising:

a leg housing secured to a seat and including a threaded inner wall;

a leg extension received into the leg housing and including external threaded portions that mate with the threaded inner wall; and a tab in the leg housing cooperating with the external threaded portions and securing the leg extension at a predefined position in the leg housing.

2. The adjustable leg for a chair as set forth in claim 1, wherein the tab includes:

a flexing portion.

3. The adjustable leg as set forth in claim 1, wherein:

a valley is defined on the leg extension between the threaded portions;

the tab is biased toward the leg extension; and the tab is secured in the valley when the leg extension is at the predefined position in the leg housing.

4. The adjustable leg as set forth in claim 3, wherein:

the leg extension is unsecured from the predefined position when a force is applied for turning the leg extension relative to the leg housing and moving the tab out of the valley and over one of the threaded portions.

5. The adjustable leg as set forth in claim 3, wherein:

the tab is positioned to ride on one of the threaded portions when the leg extension is not secured at the predefined position.

6. An adjustable leg for a chair, comprising:

a leg housing secured to a seat;

an insert secured in the leg housing including a threaded inner wall;

a leg extension received into the insert and including external threaded portions that mate with the threaded inner wall, a depression being defined between the threaded portions; and a tab on the insert cooperating with the threaded portions and the depression, the leg extension being secured at a predefined position in the insert when the tab is in the depression.

7. The adjustable leg as set forth in claim 6, wherein the insert includes:

a first insert portion including a first portion of the threaded wall; and a second insert portion including a second portion of the threaded wall, the first and second portions of the threaded wall forming the threaded inner wall of the insert when the first and second insert portions are secured together.

8. The adjustable leg as set forth in claim 6, further including:

an index, between the external threaded portions, on the leg extension.

9. The adjustable leg as set forth in claim 8, wherein:

the tab is secured by the index when the leg extension is at the predefined position in the insert.

10. The adjustable leg as set forth in claim 9, wherein:

a first portion of a wall defining a well of the tab is between the index and a first of the external threaded portions of the leg extension when the leg extension is at the predefined position in the insert;

a second portion of the wall defining the well is between the index and a second of the external threaded portions of the leg extension when the leg extension is at the predefined position in the insert; and at least one of the first and second portions of the wall defining the well is over at least one of the external threaded portions of the leg extension when the leg extension is not at the predefined position in the insert.

11. The adjustable leg as set forth in claim 6, wherein the tab is on the inner wall of the insert and includes:

a flexing portion for biasing the tab toward the leg extension.

12. The adjustable leg as set forth in claim 6, wherein:

the tab is over one of the threaded portions when the leg extension is not secured at the predefined position in the insert.

13. A chair having an adjustable leg, the leg comprising:

an upper leg portion secured to a seat;

an insert secured in the upper leg portion and including a threaded inner wall;

a lower leg portion received in the insert and including a partial external threaded portion, which mates with the threaded inner wall, and a valley; and means for providing visual and tactile feedback to a user when the lower leg portion is at a predetermined position in the upper leg portion.

14. The chair as set forth in claim 13, wherein the means for providing feedback includes:

an indicator on the lower leg portion; and a locking device on the upper leg portion cooperating with the threaded portion and the valley for securing the lower leg portion at the predefined position in the upper leg portion.

15. The chair as set forth in claim 14, wherein the locking device is seated in the valley and abuts the threaded portion when the lower leg portion is at the predefined position in the upper leg portion.

16. The chair as set forth in claim 13, wherein the insert includes:

a first insert portion defining a first portion of the threaded wall; and a second insert portion defining a second portion of the threaded wall, the first and second portions of the threaded wall mating to form the threaded inner wall of the insert.

17. An adjustable leg for a chair, comprising:

a leg housing secured to a seat;

a leg extension received into the housing and including external threaded portions that mate with a threaded inner wall of the leg housing;

a plurality of indices between the threaded portions on the leg extension; and a locking mechanism associated with the leg housing, preset positions of the leg extension within the housing being determined as a function of respective ones of the indices being engaged with the locking mechanism.

18. The adjustable leg for a chair as set forth in claim 17, wherein the locking mechanism includes:

a flexing portion; and a recessed portion biased toward a center of the housing by the flexing portion, the index engaged with the locking mechanism being removably secured in the recessed portion.

19. The adjustable leg for a chair as set forth in claim 18, wherein:

the indices and the external threaded portions of the leg extension are raised; and a wall defining the recessed portion rides on at least one of the indices and the external threaded portions when the leg extension is not at one of the preset positions.

20. The adjustable leg for a chair as set forth in claim 18, wherein the index is disengaged from the recessed portion by turning the leg extension with respect to the leg housing.

21. A method for adjusting a leg of a chair, comprising:

rotating a leg extension within an insert that is secured within a leg housing, external threaded portions of the leg extension mating with a threaded inner wall of the insert as the leg extension is rotated; and when the leg extension is at a predefined position in the insert, engaging a tab on an inner surface of the insert in a valley between the threaded portions.

22. The method for adjusting a leg of a chair as set forth in claim 21, wherein the engaging includes:

removably securing the tab in the valley.

23. The method for adjusting a leg of a chair as set forth in claim 22, further including:

removing the index from the valley by rotating the leg extension.

24. The method for adjusting a leg of a chair as set forth in claim 21, wherein the rotating includes:

riding the tab over the threaded portions of the leg extension.

25. The method for adjusting a leg of a chair as set forth in claim 21, further including:

determining the predefined position as a function of an index extending from the insert.

26. The method for adjusting a leg of a chair as set forth in claim 25, wherein the chair includes a plurality of the legs and each of the legs includes a plurality of the indices, further including leveling the chair, including:

for each of the legs, engaging a respective one of the tabs in a respective valley so that a corresponding one of the indices is exposed.

* * * * *